US005749764A

United States Patent [19]

Bailey

[11] Patent Number: 5,749,764

[45] Date of Patent: May 12, 1998

[54] AMUSEMENT SYSTEM FOR CHILDREN

[76] Inventor: Jeffrey L. Bailey, 4517 Wainwright Ave., Lansing, Mich. 48911

[21] Appl. No.: 609,352

[22] Filed: Mar. 1, 1996

[51] Int. Cl.[6] ..... A63H 33/00; A63H 3/00; A63H 3/28; A63H 3/02

[52] U.S. Cl. ..... 446/27; 446/74; 446/302; 446/369

[58] Field of Search ..... 446/27, 25, 26, 446/72, 74, 299, 302, 369, 370, 901

[56] References Cited

U.S. PATENT DOCUMENTS

| | | | |
|---|---|---|---|
| 3,285,584 | 11/1966 | Goldfarb | 446/74 X |
| 4,197,670 | 4/1980 | Cox | 446/369 |
| 4,447,250 | 5/1984 | Wolens et al. | 446/27 |
| 4,874,344 | 10/1989 | Kanter | 446/369 X |
| 4,878,871 | 11/1989 | Noto . | |
| 4,883,442 | 11/1989 | Kaplan | 446/36 X |
| 4,917,607 | 4/1990 | Van Hoose | 446/369 X |
| 4,968,281 | 11/1990 | Smith et al. | 446/369 |
| 5,027,992 | 7/1991 | Murray, III | 446/27 X |
| 5,059,149 | 10/1991 | Stone | 446/369 X |
| 5,094,621 | 3/1992 | Friedel . | |
| 5,326,300 | 7/1994 | Sonders | 446/369 X |
| 5,393,257 | 2/1995 | Spector . | |
| 5,561,864 | 10/1996 | DeMars | 446/27 X |

*Primary Examiner*—D. Neal Muir
*Attorney, Agent, or Firm*—Joseph N. Breaux

[57] ABSTRACT

An amusement system for children including a soft sculpture character having a plurality of storage pockets for holding a variety of the amusement system components including a tape recorder, a drinking vessel, and a book containing a story about the soft sculpture character; and a costume element wearable by a child that corresponds to the sculpture character to increase identification of the child with the sculpture character.

1 Claim, 2 Drawing Sheets

AMUSEMENT SYSTEM FOR CHILDREN

TECHNICAL FIELD

The present invention relates to amusement systems for children and more particularly to an amusement system for children that includes a soft sculpture character having a plurality of storage pockets for holding a variety of the amusement system components including a tape player, a drinking vessel, and a book containing a story about the soft sculpture character; and a costume element wearable by a child that corresponds to the sculpture character to increase identification of the child with the sculpture character.

BACKGROUND ART

The long periods of inactivity that generally occur when traveling an extended distance can be difficult for a child to endure. Because of this difficulty, a variety of amusement systems have been developed for occupying and reducing the boredom of a child while traveling. One effective mechanism for engaging and holding the attention of the child is to provide a story for the child that will absorb the child and reduce the child's awareness of the passage of time. It would be a benefit, therefore, to have an amusement system for children that included a story telling element to capture and hold the child's attention. It would be a further benefit, in order to increase the child's interest in the story, to provide a sculptural representation of at least one of the characters in the story. It would be an addition benefit if the system included a costume element that allowed the child to don a costume piece corresponding to one of the characters in the story in an additional effort to increase the child's interest in the story.

GENERAL SUMMARY DISCUSSION OF INVENTION

It is thus an object of the invention to provide an amusement system for children that includes a story telling capability that utilizes a magnetically recorded story telling mechanism that is operable by a child.

It is a further object of the invention to provide an amusement system for children that includes a story telling capability and also includes a soft sculptural representation of one of the characters of the story.

It is a still further object of the invention to provide an amusement system for children that includes a story telling capability and also includes a costume piece that may be worn by the child and that corresponds to one of the characters in the story.

It is a still further object of the invention to provide an amusement system for children that accomplishes all or some of the above objects in combination.

Accordingly, an amusement system for children is provided. The amusement system comprises a soft sculpture character having at least two open access pockets and at least one sealable pocket having a fastening mechanism interconnectable in a manner to seal the opening into the sealable pocket; a fabric bag containing a plurality of high density particles, the fabric bag being of a size sufficient to fit entirely within the at least one sealable pocket and, in combination with the plurality of high density particles, having a weight sufficient to maintain the soft sculpture in an upright position; a tape player assembly including a tape player device and a headphone assembly, connectable with the tape player device, having an over the head support piece; an illustrated book containing a story that includes the soft sculpture character; a cassette tape recording having the story recorded thereon in a manner to be played by the tape player device; and a costume element wearable by a child having visual characteristics identifiable with the soft sculpture character.

The amusement system also preferably includes a drinking vessel bearing indica on an outer surface thereof that corresponds to the sculpture character. The costume element is preferably attachable to the over the head support piece of the headphone assembly and more preferably is a representation of the ear appendages of the animal type depicted in the soft sculpture. The costume element is also detachably attachable to the over the head support piece of the headphone assembly to allow for removal of the costume piece for laundering or use of the head phone assembly for another purpose such as for jogging by an adult.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

An exemplary embodiment of the amusement system of the present invention is now descried with reference to FIGS. 1–4. The exemplary amusement system includes a rabbit shaped soft sculpture character, a fabric bag, a tape player assembly having a tape player and a headphone assembly, an illustrated book containing a story that includes the soft sculpture character; a cassette tape recording having the story recorded thereon in a manner to be played by the tape player, a drinking vessel bearing indica on an outer surface thereof that corresponds to the sculpture character; and a costume element that is detachable attachable to the headphone assembly that is a representation of the rabbit ears of the rabbit shaped soft sculpture character.

Figure 1:
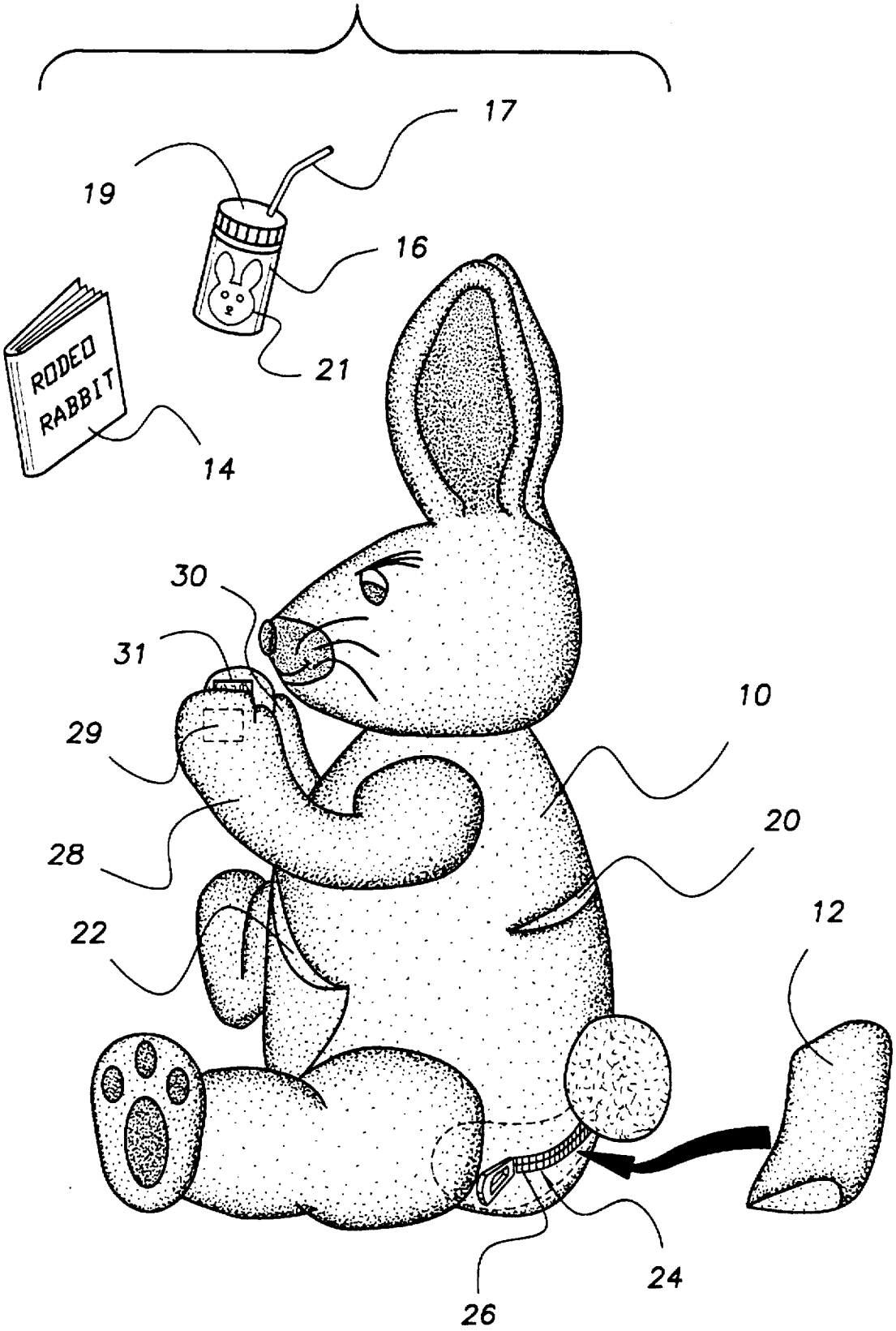
FIG. 1 is a perspective view of exemplary embodiments of the soft sculpture character, the fabric bag, the illustrated book containing a story that includes the soft sculpture character; and the drinking vessel of an exemplary embodiment of the amusement system of the present invention.

FIG. 1 is a perspective view of exemplary embodiments of a soft sculpture character 10, a fabric bag 12, an illustrated book 14 containing a story that includes soft sculpture character 10; and a drinking vessel 16 of an exemplary embodiment of the amusement system of the present invention. In this exemplary embodiment, soft sculpture character 10 is shaped to correspond to a rabbit character appearing in illustrated book 14. Sculpture character 10 has a rearwardly facing open access pocket 20 that is sized to simultaneously receive and allow storage therein of both illustrated book 14 and drinking vessel 16.

A forward facing open access pocket 22 is provided on the stomach area of sculpture character 10 that is sized receive and allow storage therein of the tape player of the tape player assembly. In this embodiment soft sculpture 10 includes a first and second forward paw 28,30. Each forward paw 28,30 has a first or second portion, 29,31 respectively, of a hook and pile type fastener attached at the end thereof that allows paws 28,30 to be secured together to assist in maintaining the tape player within forward access pocket 22 if desired.

A ballast pocket 24 having a zipper closure 26 is provided in the buttocks portion of sculpture character 10. Ballast pocket 24 is sized to completely receive therein fabric bag 12 when fabric bag 12 is filled to about ninety-percent capacity with dried beans. The volume of beans filling bag 12 is selected to be sufficient to concentrate enough weight at the bottom of sculpture character 10 to maintain sculpture character 10 in an upright position when placed on a substantially flat automobile seat.

In this embodiment, drinking vessel 16 is a conventional closed top child's drinking vessel having a straw type drinking tube 17 extending from a top cover 19 thereof. The outer surface of drinking vessel 16 has a raised sculptural representation 21 of the rabbit character of illustrated book 14 formed thereon.

Figure 2:
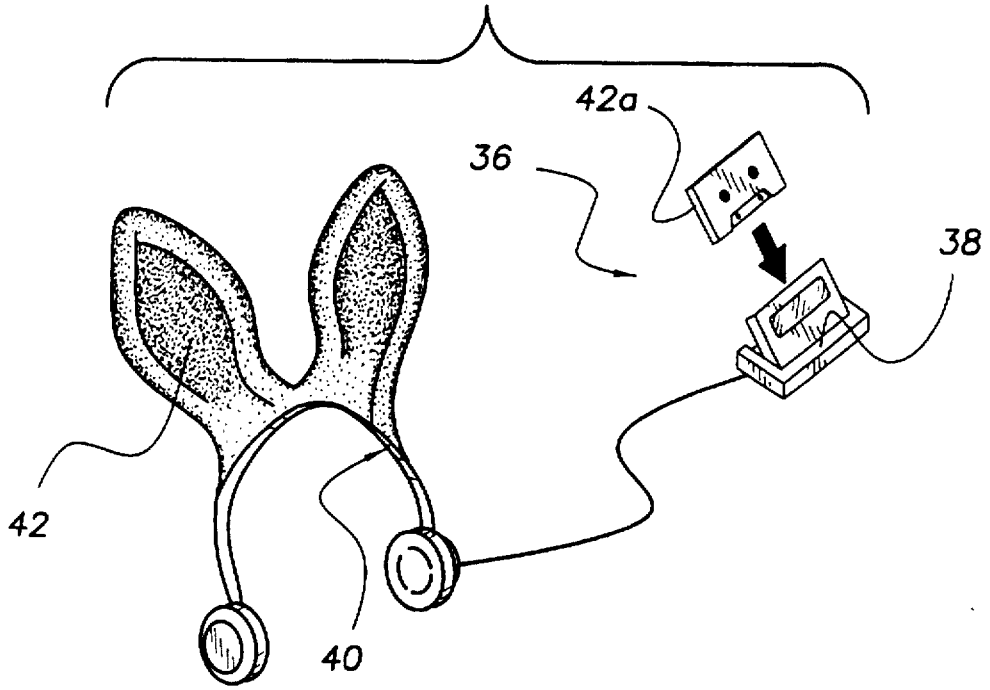
FIG. 2 is a perspective view of exemplary embodiments of the tape player device and the headphone assembly of the tape player assembly, the cassette tape recording having the same story as in the book of FIG. 1 recorded thereon, and the costume element.
Figure 3:
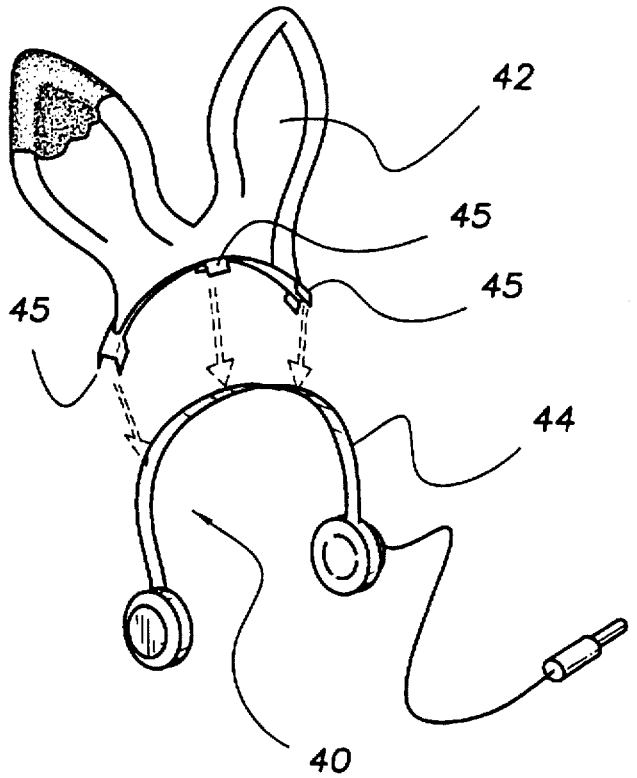
FIG. 3 is a perspective view showing the exemplary headphone assembly with the exemplary costume element detached from the over the head support piece thereof.
Figure 4:
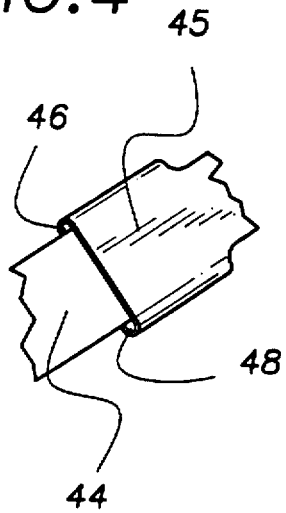
FIG. 4 is a perspective view showing one of the three crimp connectors provide on the costume element for detachably securing the costume element to the over the head support piece of the head phone assembly.

FIG. 2 shows an exemplary tape player assembly, generally referenced by the numeral 36, including a conventional cassette tape player device 38 and conventional headphone assembly 40; a cassette tape recording 42 having the same story as illustrated book 14 recorded thereon in a manner to be played by tape player device 38; and a costume element 42 that is secured to headphone assembly 40. With reference to FIG. 3, costume element 42 is shaped to resemble the ears of sculpture character 10 and is secured to an over the head support member 44 of headphone assembly 40 with three crimp connectors 45. FIG. 4 is a detail view of one of the three crimp connectors 45 showing a pair of gripping edges 46,48 curled around and frictionally gripping support member 44.

With reference once again to FIG. 2, inclusion of costume element 42 on headphone assembly 40 encourages the child to place the head phones on and listen quietly and privately to cassette recording 42. This allows the adults in the vehicle to carry on normal conversation or listen to the radio in a normal fashion.

Use of the amusement system of the present invention is now described with general reference to FIGS. 1–4. At the beginning of a trip, a story is selected and the corresponding illustrated book 14 and cassette tape 42 are provided. It can be seen that a variety of different stories containing the same sculpture character 10 can be provided. If the trip is to be a long one, a liquid refreshment, such as fruit juice or punch, may be placed within the drinking vessel. The drinking vessel may then be inserted into rearward facing open access pocket 20 until desired by the child. Cassette tape 42 is inserted into tape player device 38 and headphone assembly 40 put onto the child's head. As discussed hereinbefore, incorporation of costume element 42 increases the child's interest in wearing headphone assembly 40. The child may then turn on tape player device 38 and listen to the story while reading along or viewing the pictures corresponding to the story in illustrated book 14. If the child becomes tired, sculpture character 10 can double as a pillow and sleeping companion. If a long trip is anticipated, more than one cassette tape 42 and illustrated book 14 pair may be brought along to provide a variety of stories for the child.

It can be seen from the preceding description that an amusement system for children has been provided that includes a story telling capability, that utilizes a magnetically recorded story telling mechanism, that includes a soft sculptural representation of one of the characters of the story, that includes a costume piece that may be worn by the child and that corresponds to one of the characters in the story.

It is noted that the embodiment of the amusement system for children described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An amusement system for children comprising:

a soft sculpture character having at least two open access pockets and at least one sealable pocket having a fastening mechanism interconnectable in a manner to seal said opening into said sealable pocket;

a fabric bag containing a plurality of high density particles, said fabric bag being of a size sufficient to fit entirely within said at least one sealable pocket and, in combination with said plurality of high density particles, having a weight sufficient to maintain said soft sculpture character in an upright position, said fabric bag filled with said high density particles being removably positionable within said at least one sealable pocket;

a tape player assembly including a tape player device and a headphone assembly, connectable with said tape player device, having an over said head support piece;

an illustrated book containing a story that includes said soft sculpture character;

a cassette tape recording having said story recorded thereon in a manner to be played by said tape player device;

a costume element wearable by a child having visual characteristics identifiable with said soft sculpture character; and a drinking vessel bearing indica on an outer surface thereof that corresponds to said soft sculpture character, said drinking vessel including a straw type drinking tube extending from a top cover of said drinking vessel;

said costume element being a representation of ear appendages as depicted in said soft sculpture character, said costume element being detachably attachable to said over the head support piece of said headphone assembly with at least one crimp connector, each said crimp connector including a pair of gripping edges curlable around and frictionally gripping a portion of said headphone assembly;

said soft sculpture character having a rearwardly facing open access pocket that is sized to simultaneously receive and allow storage therein of both said illustrated book and said drinking vessel and a forward facing open access pocket that is provided on a stomach area of said soft sculpture character that is sized to receive and allow storage therein of said tape player;

said soft sculpture character further including a first and a second forward paw, each said first and second forward paws each having a portion of a hook and pile type fastener attached at an end thereof in a manner that allows said first and second paws to be secured together to assist in maintaining said tape player within said forward facing access pocket.

* * * * *